US011543111B1

(12) United States Patent
Yeates

(10) Patent No.: US 11,543,111 B1
(45) Date of Patent: Jan. 3, 2023

(54) WIRELESS LIGHT SOCKET ASSEMBLY

(71) Applicant: David Yeates, Starkville, MS (US)

(72) Inventor: David Yeates, Starkville, MS (US)

( * ) Notice: Subject to any disclaimer, the term of this patent is extended or adjusted under 35 U.S.C. 154(b) by 0 days.

(21) Appl. No.: 17/676,921

(22) Filed: Feb. 22, 2022

(51) Int. Cl.
*F21V 23/04* (2006.01)
*F21V 23/06* (2006.01)

(52) U.S. Cl.
CPC ..... *F21V 23/0435* (2013.01); *F21V 23/06* (2013.01)

(58) Field of Classification Search
CPC ..... F21V 23/0435; F21V 23/06
See application file for complete search history.

(56) References Cited

U.S. PATENT DOCUMENTS 4,642,477 A * 2/1987 Grzanowski, Jr. ..... G08B 7/064 307/115
5,449,976 A * 9/1995 Kemp ..... H05B 41/34 315/86
5,992,094 A * 11/1999 Diaz ..... G01V 1/008 109/6
7,012,544 B2 3/2006 Cunningham
7,701,355 B1 * 4/2010 Billman ..... G08B 7/066 340/627
10,349,495 B2 * 7/2019 Fathollahi ..... F21V 23/04
10,352,101 B2 7/2019 Cook
D860,946 S 9/2019 Wang
10,687,406 B2 6/2020 Nimmer
10,909,823 B2 2/2021 Rossi
2005/0128068 A1 * 6/2005 Winick ..... G08B 25/008 340/517
2008/0169910 A1 * 7/2008 Greene ..... H02J 50/70 340/10.34
2016/0173746 A1 * 6/2016 Chien ..... H04N 7/181 348/159
2017/0175996 A1 * 6/2017 Chien ..... F21S 9/022
2020/0211341 A1 * 7/2020 Rossi ..... H05B 47/115

FOREIGN PATENT DOCUMENTS

CA 2089896 8/1993
KR 2009072446 A * 7/2009

* cited by examiner

*Primary Examiner* — Mary Ellen Bowman

(57) ABSTRACT

A wireless light socket assembly for remotely actuating a light bulb includes a socket unit that has a male connector that is threadable into an existing light socket in a building. The socket unit has a female coupler integrated into the socket for insertably receiving a light bulb and the female coupler is in communication with the male connector. A communication unit is integrated into the socket unit and the communication unit is in remote communication with a security system of the building. The communication unit actuates the female coupler when the communication unit receives an alert signal from the security system to visually alert an observer that the security system has been triggered.

10 Claims, 4 Drawing Sheets

WIRELESS LIGHT SOCKET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION

(1) Field of The Invention

The disclosure relates to light socket devices and more particularly pertains to a new light socket device for remotely actuating a light bulb. The device includes a socket unit that is threadable into an existing light socket and which threadably receives a light bulb. The socket unit is in wireless communication with a security system and the light bulb is turned on when the security system is triggered. Additionally, the device includes a remote control for remotely actuating or de-actuating the light bulb.

(2) Description of Related Art Including Information Disclosed Under 37 CFR 1.97 and 1.98

The prior art relates to light socket devices including a light switch that is in wireless communication with a security system. The prior art discloses a strobe light control that is in communication with a security system. The prior art discloses an illuminated sign that is in wireless communication with a message communication device. The prior art discloses a light bulb socket that is in wireless communication with a personal electronic device. The prior art discloses a smart light bulb that has motion sensing capabilities. The prior art discloses an ornamental design for a light bulb adapter which includes a cylindrical housing.

BRIEF SUMMARY OF THE INVENTION

An embodiment of the disclosure meets the needs presented above by generally comprising a socket unit that has a male connector that is threadable into an existing light socket in a building. The socket unit has a female coupler integrated into the socket for insertably receiving a light bulb and the female coupler is in communication with the male connector. A communication unit is integrated into the socket unit and the communication unit is in remote communication with a security system of the building. The communication unit actuates the female coupler when the communication unit receives an alert signal from the security system to visually alert an observer that the security system has been triggered.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
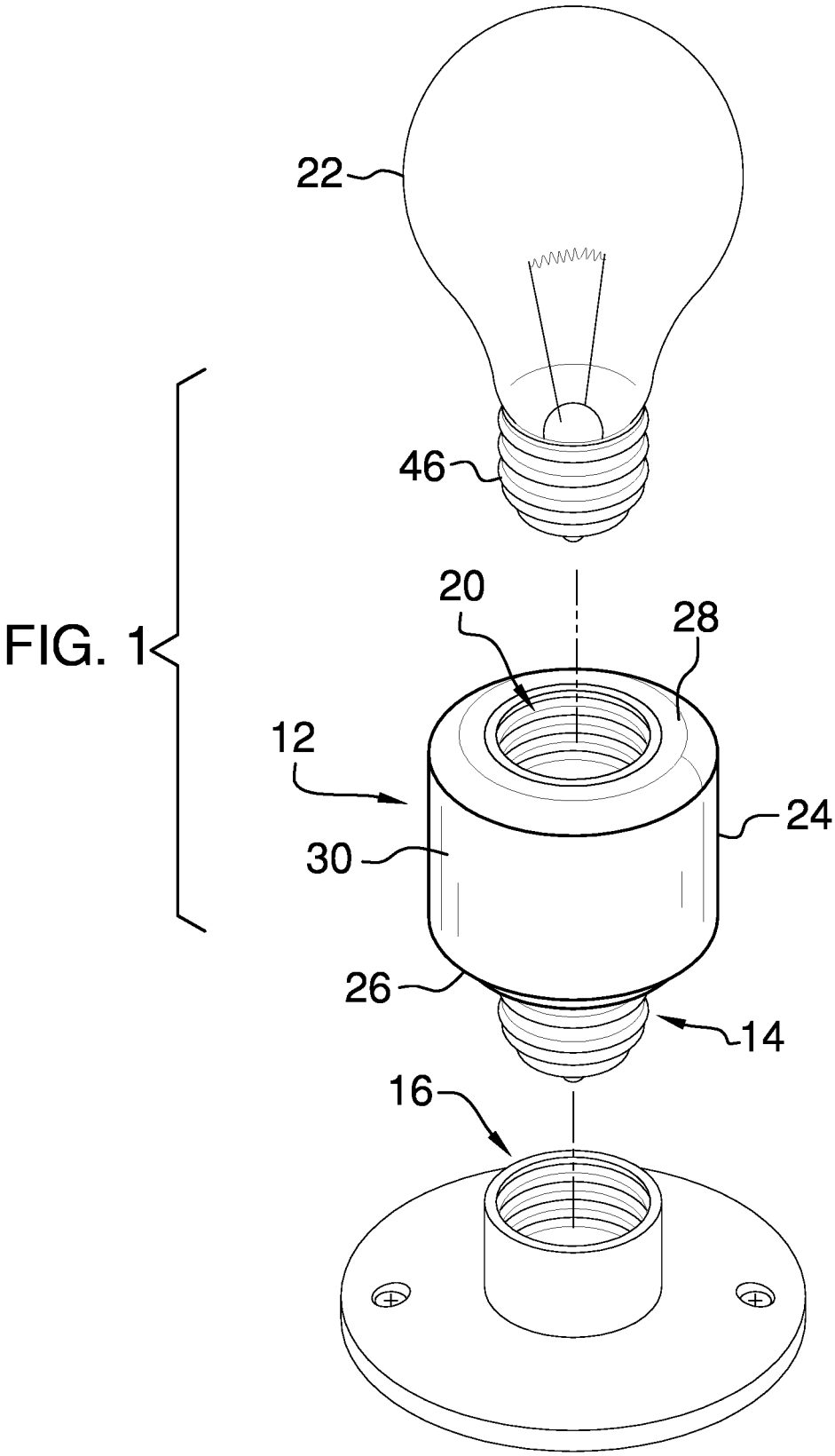
FIG. 1 is an exploded perspective view of a wireless light socket assembly according to an embodiment of the disclosure.
Figure 2:
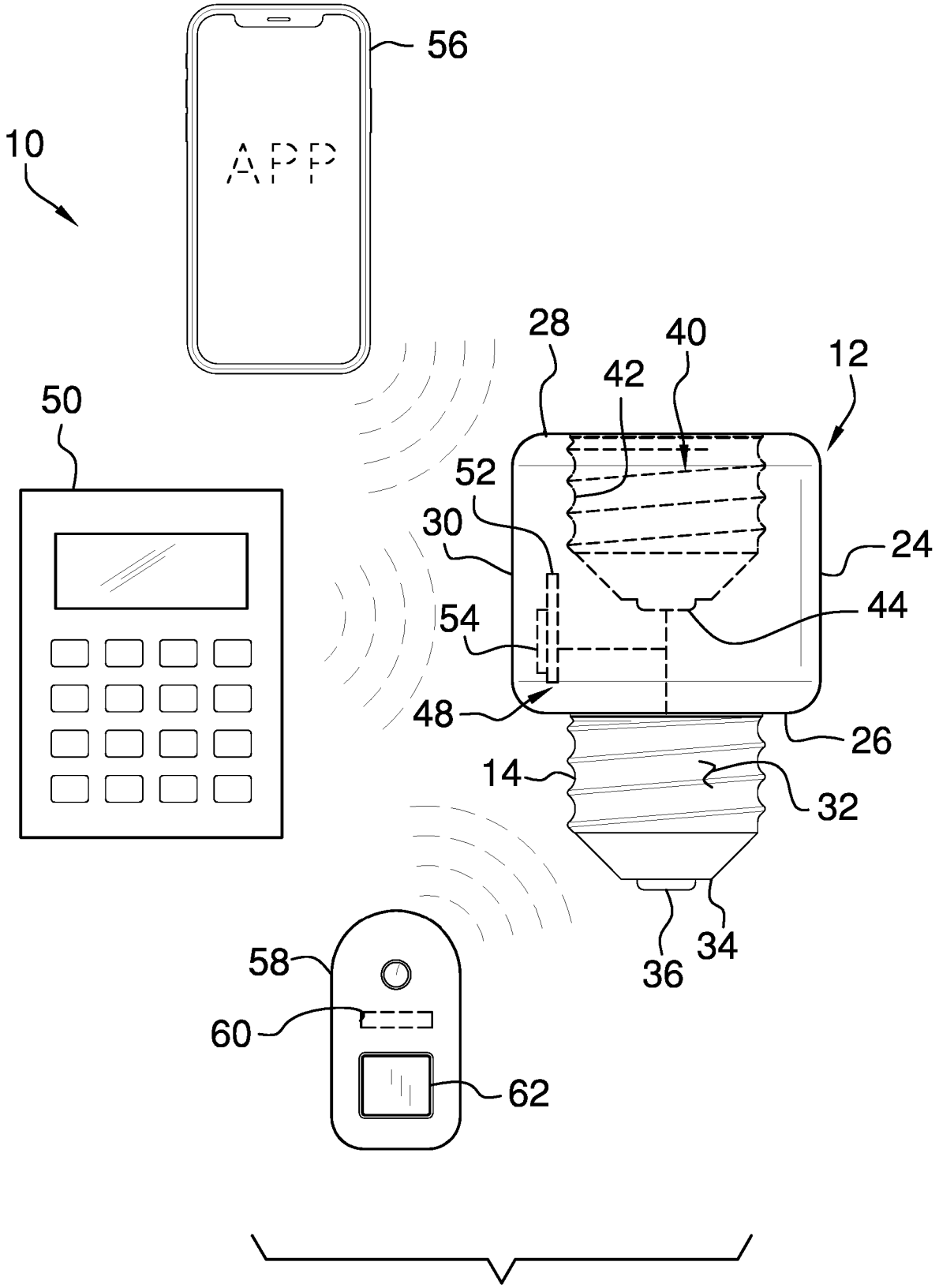
FIG. 2 is a perspective phantom view of an embodiment of the disclosure.
Figure 3:
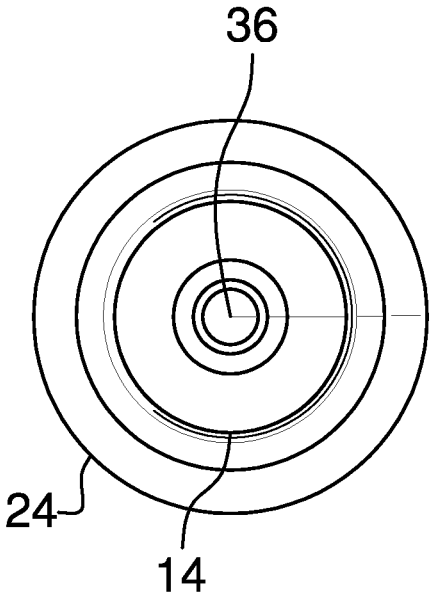
FIG. 3 is a top view of a socket unit of an embodiment of the disclosure.
Figure 4:
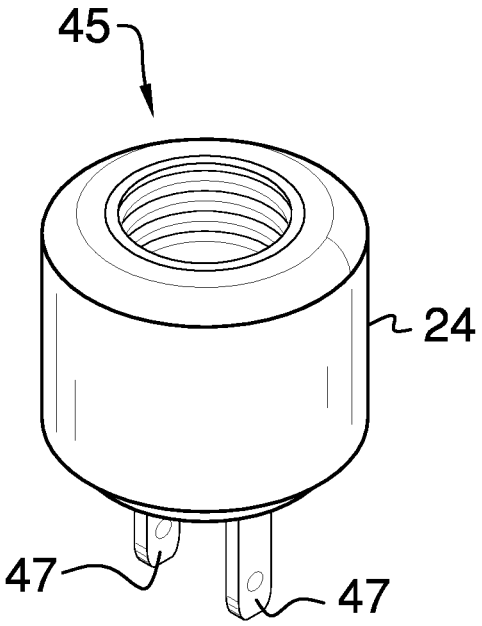
FIG. 4 is a perspective view of an alternative embodiment of the disclosure.
Figure 5:
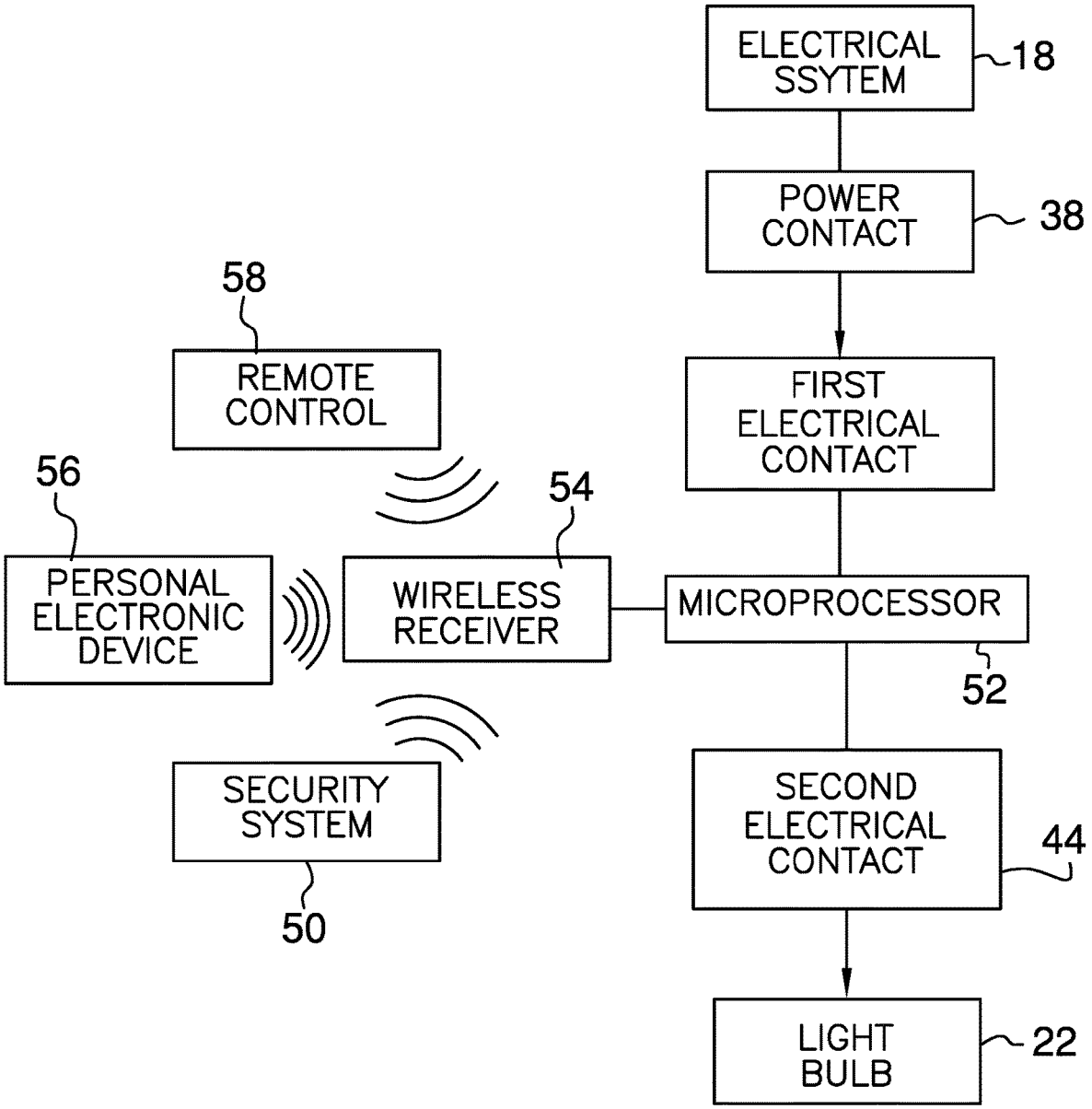
FIG. 5 is a schematic view of an embodiment of the disclosure.

With reference now to the drawings, and in particular to FIGS. 1 through 5 thereof, a new light socket device embodying the principles and concepts of an embodiment of the disclosure and generally designated by the reference numeral 10 will be described.

As best illustrated in FIGS. 1 through 5, the wireless light socket assembly 10 generally comprises a socket unit 12 that has a male connector 14 which is threadable into an existing light socket 16 in a building such that the male connector 14 is in electrical communication with an electrical system 18 of the building. The building may be a house, an apartment or any other type of occupancy. The socket unit 12 has a female coupler 20 that is integrated into the socket unit 12 for insertably receiving a light bulb 22 and the female coupler 20 is in communication with the male connector 14. The socket unit 12 includes a housing 24 that has a top wall 26, a bottom wall 28 and an outer wall 30 extending between the top wall 26 and the bottom wall 28, and the outer wall 30 is continuously arcuate about an axis extending between the top wall 26 and the bottom wall 28.

The male connector 14 is coupled to and extends upwardly from the top wall 26, and the male connector 14 has an outer surface 32 and a distal end 34 with respect to the top wall 26. The outer surface 32 is threaded and the male connector 14 has a first electrical contact 36 that is disposed on the distal end 34 of the male connector 14. Furthermore, the first electrical contact 36 is comprised of an electrically conductive material. The outer surface 32 threadably engages the existing light socket 16 having the first electrical contact 36 on the distal end 34 engaging and being in electrical communication with a power contact 38 in the existing light socket 16.

The bottom wall 28 has a well 40 extending toward the top wall 26 such that the well 40 defines the female coupler 20, and the well 40 has a bounding surface 42 that is threaded. The well 40 has a second electrical contact 44 that is positioned within the well 40 and the second electrical contact 44 is comprised of an electrically conductive material. The well 40 insertably receives a threaded cap 46 of a light bulb 22 such that the light bulb 22 is in electrical communication with the second electrical contact 44. The light bulb 22 may be an incandescent light bulb, a light emitting diode light bulb or any other conventional type of light bulb. In an alternative embodiment 45 as is most clearly shown in FIG. 4, a pair of male electrical contacts 47 is coupled to and extends away from the bottom wall 28 of the housing 24 for engaging a female electrical plug.

A communication unit 48 is integrated into the socket unit 12 and the communication unit 48 is in remote communication with a security system 50 of the building. The security system 50 may be an electronic intruder alarm system of any conventional design that has wireless communication capabilities. The communication unit 48 is in communication with the female coupler 20 and the communication unit 48 actuates the female coupler 20 when the communication unit 48 receives an alert signal from the security system 50. In this way the light bulb 22 can be turned on to visually alert an observer that the security system 50 has been triggered.

The communication unit 48 comprises a control circuit 52 that is integrated into the housing 24. The control circuit 52 is electrically coupled to the first electrical contact 36 such that the control circuit 52 is in electrical communication with the electrical system 18 of the building. The control circuit 52 is electrically coupled to the second electrical contact 44 and the control circuit 52 receives an alert input, a first actuate input and a second actuate input. The control circuit 52 places the second electrical contact 44 in electrical communication with the electrical system 18 of the building when the control circuit 52 receives any of the alert input, the first actuate input or the second actuate input.

The communication unit 48 includes a receiver 54 is integrated into the socket unit 12. The receiver 54 is in remote communication with the security system 50 of the building and the receiver 54 is electrically coupled to the control circuit 52. The control circuit 52 receives the alert input when the receiver 54 receives an alert signal from the security system 50. Additionally, the receiver 54 receives the alert signal from the security system 50 when the security system 50 is triggered. The receiver 54 may comprise a radio frequency receiver or the like and the receiver 54 may employ Bluetooth communication protocols. The receiver 54 is in remote communication with a personal electronic device 56 thereby facilitating the receiver 54 to receive a first actuate signal from the personal electronic device 56. Additionally, the control circuit 52 receives the first actuate input when the receiver 54 receives the first actuate signal. The personal electronic device 56 may comprise a smart phone or the like and the smart phone may store a smart phone application for remotely controlling the socket unit 12.

A remote control 58 is provided that is in remote communication with the communication unit 48. The remote control 58 broadcasts a remote actuate signal to the communication unit 48 when the remote control 58 is actuated. Furthermore, the communication unit 48 actuates the female coupler 20 when the communication unit 48 receives the remote actuate signal. The remote control 58 comprises a transmitter 60 that is integrated into the remote control 58 and the transmitter 60 broadcasts the remote actuate signal when the transmitter 60 is turned on. The transmitter 60 may comprise a radio frequency transmitter or the like. An actuate button 62 is movably integrated into the remote control 58, the actuate button 62 is electrically coupled to the transmitter 60 and the transmitter 60 is turned on when the actuate button 62 is depressed.

In use, the socket unit 12 is threaded into the existing light socket 16 and the light bulb 22 is threaded into the socket unit 12. The communication unit 48 is in wireless communication with the security system 50 such that the light bulb 22 is turned on when the security system 50 is triggered. In this way the light bulb 22 can deter an intruder from progressing with breaking and entering, for example. Furthermore, the light bulb 22 can be remotely turned on with either the personal electronic device 56 or the remote control 58.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded.

A reference to an element by the indefinite article "a" does not exclude the possibility that more than one of the element is present, unless the context clearly requires that there be only one of the elements.

I claim:

1. A wireless light socket assembly being in remote communication with a home security system such that a light bulb is turned on when the home security system is activated, said assembly comprising:

a socket unit having a male connector being threadable into an existing light socket in a building wherein said male connector is in electrical communication with an electrical system of the building, said socket unit having a female coupler being integrated into said socket for insertably receiving a light bulb, said female coupler being in communication with said male connector;

a communication unit being integrated into said socket unit, said communication unit being in remote communication with a security system of the building, said communication unit being in communication with said female coupler, said communication unit actuating said female coupler when said communication unit receives an alert signal from the security system thereby facilitating the light bulb to be turned on wherein said light bulb is configured to visually alert an observer that the security system has been triggered; and a remote control being in remote communication with said communication unit, said remote control broadcasting a remote actuate signal to said communication unit when said remote control is actuated, said communication unit actuating said female coupler when said communication unit receives said remote actuate signal.

2. The assembly according to claim 1, wherein.:

said socket unit includes a housing having a top wall, a bottom wall and an outer wall extending between said top wall and said bottom wall, said outer wall being continuously arcuate about an axis extending between said top wall and said bottom wall; and said male connector is coupled to and extends upwardly from said top wall, said male connector having an outer surface and a distal end with respect to said top wall, said outer surface being threaded, said male connector having an first electrical contact being disposed on said distal end of said male connector, said first electrical contact being comprised of an electrically conductive material, said outer surface threadably engaging the existing light socket having said first electrical contact on said distal end engaging and being in electrical communication with a power contact in the existing light socket.

3. The assembly according to claim 2, wherein said bottom wall has a well extending toward said top wall such that said well defines said female coupler, said well having a bounding surface being threaded, said well having a second electrical contact being positioned within said well, said second electrical contact being comprised of an electrically conductive material, said well insertably receiving a threaded cap of a light bulb such that the light bulb is in electrical communication with said second electrical contact.

4. The assembly according to claim 2, wherein said communication unit comprises a control circuit being integrated into said housing, said control circuit being electrically coupled to said first electrical contact such that said control circuit is in electrical communication with the electrical system of the building, said control circuit being electrically coupled to said second electrical contact, said control circuit receiving an alert input, said control circuit receiving a first actuate input, said control circuit receiving a second actuate input, said control circuit placing said second electrical contact in electrical communication with the electrical system of the building when said control circuit receives any of said alert input, said first actuate input or said second actuate input.

5. The assembly according to claim 4, wherein said communication unit includes a receiver being integrated into said socket unit, said receiver being in remote communication with a security system of the building, said receiver being electrically coupled to said control circuit, said control circuit receiving said alert input When said receiver receives an alert signal from the security system, said receiver receiving said alert signal from the security system when the security system is triggered.

6. The assembly according to claim 4, wherein said receiver is in remote communication with a personal electronic device thereby facilitating said receiver to receive a first actuate signal from the personal electronic device, said control circuit receiving said first actuate input when said receiver receives said first actuate signal.

7. The assembly according to claim 1, wherein said remote control comprises:

a transmitter being integrated into said remote control, said transmitter broadcasting said remote actuate signal when said transmitter is turned on; and an actuate button being movably integrated into said remote control, said actuate button being electrically coupled to said transmitter, said transmitter being turned on when said actuate button is depressed.

8. A wireless light socket assembly being in remote communication with a home security system such that a light bulb is turned on when the home security system is activated, said assembly comprising:

a socket unit having a male connector being threadable into an existing light socket in a building wherein said male connector is in electrical communication with an electrical system of the building, said socket unit having a female coupler being integrated into said socket for insertably receiving a light bulb, said female coupler being in communication with said male connector, said socket unit including a housing having a top wall, a bottom wall and an outer wall extending between said top wall and said bottom wall, said outer wall being continuously arcuate about an axis extending between said top wall and said bottom wall, said male connector being coupled to and extending upwardly from said top wall, said male connector having an outer surface and a distal end with respect to said top wall, said outer surface being threaded, said male connector having an first electrical contact being disposed on said distal end of said male connector, said first electrical contact being comprised of an electrically conductive material, said outer surface threadably engaging the existing light socket having said first electrical contact on said distal end engaging and being in electrical communication with a power contact in the existing light socket, said bottom wall having a well extending toward said top wall such that said well defines said female coupler, said well having a bounding surface being threaded, said well having a second electrical contact being positioned within said well, said second electrical contact being comprised of an electrically conductive material, said well insertably receiving a threaded cap of a light bulb such that the light bulb is in electrical communication with said second electrical contact;

a communication unit being integrated into said socket unit, said communication unit being in remote communication with a security system of the building, said communication unit being in communication with said female coupler, said communication unit actuating said female coupler when said communication unit receives an alert signal from the security system thereby facilitating the light bulb to be turned on wherein said light bulb is configured to visually alert an observer that the security system has been triggered, said communication unit comprising:

a control circuit being integrated into said housing, said control circuit being electrically coupled to said first electrical contact such that said control circuit is in electrical communication with the electrical system of the building, said control circuit being electrically coupled to said second electrical contact, said control circuit receiving an alert input, said control circuit receiving a first actuate input, said control circuit receiving a second actuate input, said control circuit placing said second electrical contact in electrical communication with the electrical system of the building when said control circuit receives any of said alert input, said first actuate input or said second actuate input; and a receiver being integrated into said socket unit, said receiver being in remote communication with the security system of the building, said receiver being electrically coupled to said control circuit, said control circuit receiving said alert input when said receiver receives an alert signal from the security system, said receiver receiving said alert signal from the security system when the security system is triggered, said receiver being in remote communication with a personal electronic device thereby facilitating said receiver to receive a first actuate signal from the personal electronic device, said control circuit receiving said first actuate input when said receiver receives said first actuate signal; and a remote control being in remote communication with said communication unit, said remote control broadcasting a remote actuate signal to said communication unit when said remote control is actuated, said communication unit actuating said female coupler when said communication unit receives said remote actuate signal, said remote control comprising:

a transmitter being integrated into said remote control, said transmitter broadcasting said remote actuate signal when said transmitter is turned on; and an actuate button being movably integrated into said remote control, said actuate button being electrically coupled to said transmitter, said transmitter being turned on when said actuate button is depressed.

9. The assembly according to claim 8, further comprising a pair of male electrical contacts being coupled to and extending away from said bottom wall of said housing for engaging a female electrical plug.

10. A wireless light socket system being in remote communication with a home security device such that a light bulb is turned on when the home security device is activated, said systme comprising:

a security device being installed in a building, said security device broadcasting an alert signal when said security device is triggered;

a socket unit having a male connector being threadable into an existing light socket in a building wherein said male connector is in electrical communication with an electrical system of the building, said socket unit having a female coupler being integrated into said socket for insertably receiving a light bulb, said female coupler being in communication with said male connector, said socket unit including a housing having a top wall, a bottom wall and an outer wall extending between said top wall and said bottom wall, said outer wall being continuously arcuate about an axis extending between said top wall and said bottom wall, said male connector being coupled to and extending upwardly from said top wall, said male connector having an outer surface and a distal end with respect to said top wall, said outer surface being threaded, said male connector having an first electrical contact being disposed on said distal end of said male connector, said first electrical contact being comprised of an electrically conductive material, said outer surface threadably engaging the existing light socket having said first electrical contact on said distal end engaging and being in electrical communication with a power contact in the existing light socket, said bottom wall having a well extending toward said top wall such that said well defines said female coupler, said well having a bounding surface being threaded, said well having a second electrical contact being positioned within said well, said second electrical contact being comprised of an electrically conductive material, said well insertably receiving a threaded cap of a light bulb such that the light bulb is in electrical communication with said second electrical contact;

a communication unit being integrated into said socket unit, said communication unit being in remote communication with said security device, said communication unit being in communication with said female coupler, said communication unit actuating said female coupler when said communication unit receives said alert signal from the security device thereby facilitating the light bulb to be turned on wherein said light bulb is configured to visually alert an observer that said security device has been triggered, said communication unit comprising:

a control circuit being integrated into said housing, said control circuit being electrically coupled to said first electrical contact such that said control circuit is in electrical communication with the electrical system of the building, said control circuit being electrically coupled to said second electrical contact, said control circuit receiving an alert input, said control circuit receiving a first actuate input, said control circuit receiving a second actuate input, said control circuit placing said second electrical contact in electrical communication with the electrical system of the building when said control circuit receives any of said alert input, said first actuate input or said second actuate input; and a receiver being integrated into said socket unit, said receiver being in remote communication with said security device, said receiver being electrically coupled to said control circuit, said control circuit receiving said alert input when said receiver receives said alert signal from the security device, said receiver receiving said alert signal from the security device when the security device is triggered, said receiver being in remote communication with a personal electronic device thereby facilitating said receiver to receive a first actuate signal from the personal electronic device, said control circuit receiving said first actuate input when said receiver receives said first actuate signal; and a remote control being in remote communication with said communication unit, said remote control broadcasting a remote actuate signal to said. communication unit when said remote control is actuated, said communication unit actuating said female coupler when said communication unit receives said remote actuate signal, said remote control comprising:

a transmitter being integrated into said remote control, said transmitter broadcasting said remote actuate signal when said transmitter is turned on; and an actuate button being movably integrated into said remote control, said actuate button being electrically coupled to said transmitter, said transmitter being turned on when said actuate button is depressed.

* * * * *